US011510459B2

(12) United States Patent
Houng et al.

(10) Patent No.: US 11,510,459 B2
(45) Date of Patent: Nov. 29, 2022

(54) OUTSOLE FOR AN ARTICLE OF FOOTWEAR

(71) Applicant: NIKE, Inc., Beaverton, OR (US)

(72) Inventors: Derek Houng, Portland, OR (US); Benjamin Nethongkome, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 70 days.

(21) Appl. No.: 16/555,621

(22) Filed: Aug. 29, 2019

(65) Prior Publication Data

US 2021/0059354 A1 Mar. 4, 2021

(51) Int. Cl.

| | |
|---|---|
| ***A43B 13/16*** | (2006.01) |
| ***A43B 13/22*** | (2006.01) |
| ***A43B 5/00*** | (2022.01) |
| ***A43B 13/12*** | (2006.01) |

(52) U.S. Cl.

CPC ..... *A43B 13/223* (2013.01); *A43B 5/00* (2013.01); *A43B 13/12* (2013.01); *A43B 13/16* (2013.01)

(58) Field of Classification Search

CPC ..... A43B 5/025; A43B 13/122; A43B 13/16; A43B 13/223; A43B 13/26

See application file for complete search history.

(56) References Cited

U.S. PATENT DOCUMENTS 4,559,723 A * 12/1985 Hamy ..... A43B 5/00 36/102
6,076,283 A * 6/2000 Boie ..... A43B 13/223 36/114
6,931,768 B2 * 8/2005 Baek ..... A43B 7/1425 36/113
7,941,946 B2 * 5/2011 Clancy ..... A43B 13/223 36/113
8,181,364 B2 * 5/2012 Mayden ..... A43B 7/144 36/103
8,573,981 B2 * 11/2013 Morag ..... A63B 69/002 434/251
8,935,861 B2 * 1/2015 Baker ..... A43B 23/027 36/97

(Continued)

FOREIGN PATENT DOCUMENTS

| | | |
|---|---|---|
| GB | 940 925 A | 11/1963 |
| WO | WO 99/38406 A1 | 8/1999 |

OTHER PUBLICATIONS

Search Report and Written Opinion for PCT/US2020/042925, dated Nov. 4, 2020 (14 pages).

*Primary Examiner* — Sharon M Prange
(74) *Attorney, Agent, or Firm* — Klarquist Sparkman, LLP

(57) ABSTRACT

An article of footwear includes a medial side portion, a lateral side portion, and an outsole extending from the medial side portion to the lateral side portion and configured to contact a ground surface. The outsole may include a first portion having a first traction surface configured for engaging the ground surface, the first traction surface disposed on the medial side portion and including one or more first traction elements. The outsole may further include a second portion having a second traction surface configured for engaging the ground surface, the second portion disposed on the medial side portion and extending in a superior direction from the first portion, the second traction surface including one or more second traction elements.

18 Claims, 11 Drawing Sheets

(56) References Cited

U.S. PATENT DOCUMENTS

| | | | | |
|---|---|---|---|---|
| 9,693,604 | B2 * | 7/2017 | Cin | A43B 13/14 |
| 9,833,039 | B2 * | 12/2017 | Smaldone | A43B 23/027 |
| 2005/0268492 | A1 * | 12/2005 | Fuerst | A43B 1/0027 36/77 R |
| 2011/0258883 | A1 | 10/2011 | Collin et al. | |
| 2015/0089842 | A1 | 4/2015 | Zamer-Juarez | |

* cited by examiner

OUTSOLE FOR AN ARTICLE OF FOOTWEAR

FIELD

This disclosure relates generally to articles of footwear and more particularly to outsoles for articles of footwear.

BACKGROUND

An article of footwear (also referred to herein as "article") typically includes two main components: a sole structure and an upper. The sole structure is configured for supporting the wearer's foot and providing cushioning between the wearer's foot and the ground. The sole structure may include an outsole that is adapted to contact the ground. The upper is coupled to the sole structure and is configured for securing the wearer's foot to the sole structure.

DETAILED DESCRIPTION

General Considerations

Figure 1:
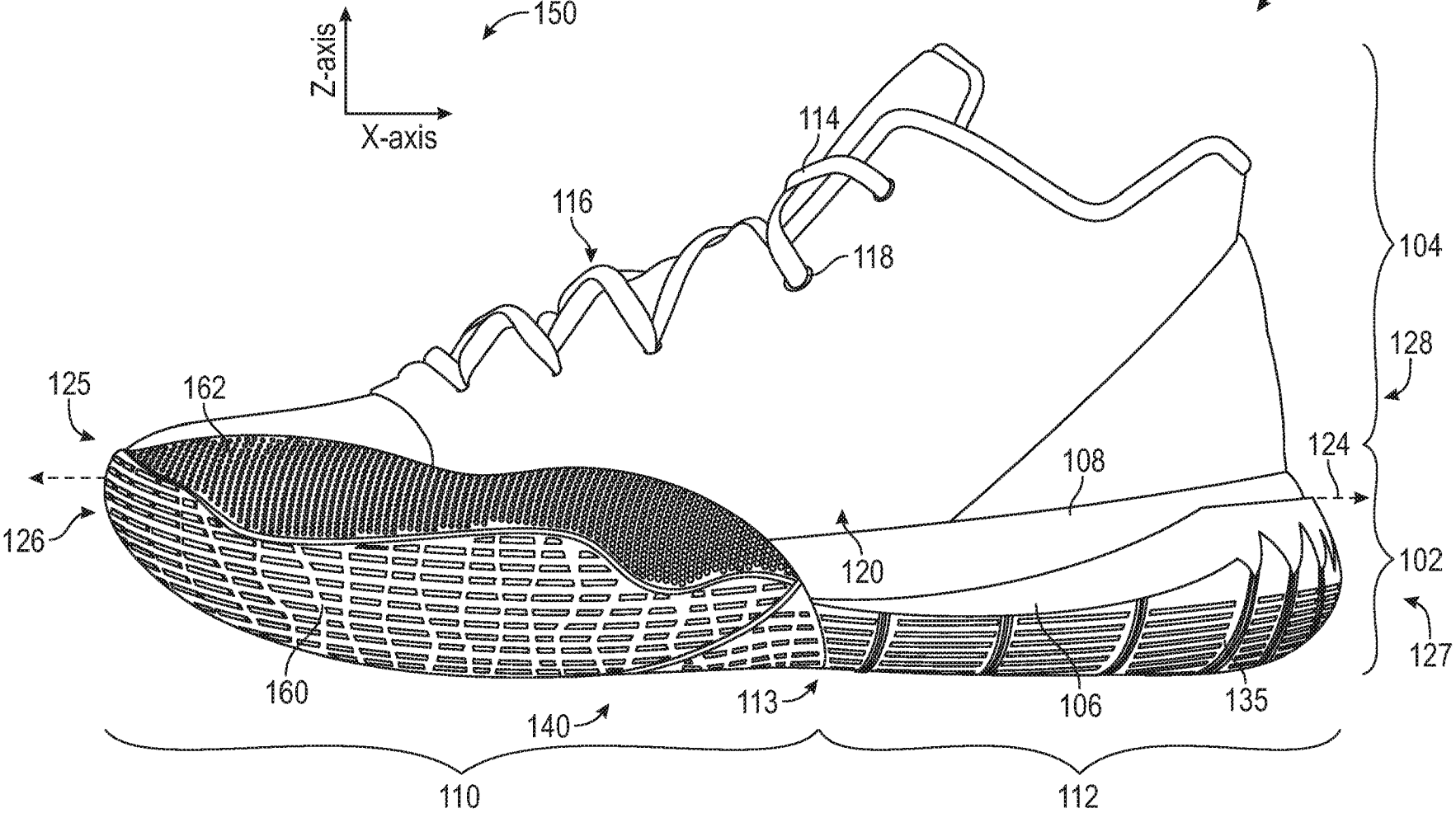
FIG. 1 is a medial side view of an exemplary article of footwear.

The systems and methods described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application the singular forms "a," "an," and "the" include the plural forms unless the context clearly dictates otherwise. Additionally, the term "includes" means "comprises." Further, the term "coupled" or "secured" encompasses mechanical and chemical couplings, as well as other practical ways of coupling or linking items together, and does not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article from the heel to toe. Similarly, a "longitudinal length" refers to a length of the article along the longitudinal axis and a "longitudinal direction" refers to a direction along the longitudinal axis.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "fixedly attached" and "fixedly coupled" refer to two components joined in a manner such that the components may not be readily separated from one another without destroying and/or damaging one or both of the components. Exemplary modalities of fixed attachment may include joining with permanent adhesive, stitches, welding or other thermal bonding, and/or other joining techniques. In addition, two components may be "fixedly attached" or "fixedly coupled" by virtue of being integrally formed, for example, in a molding process. In contrast, the terms "temporarily attached," "temporarily coupled," or "temporarily fixed," refer to two components joined in a manner such that the components can be readily separated from one another to return to their separate, discrete forms without destroying and/or damaging either component. Exemplary modalities of temporary attachment may include removable stitches or other temporary joining techniques.

As used herein, the terms "articles of footwear" or "articles" mean any type of footwear, including, for example, basketball shoes, volleyball shoes, tennis shoes, running shoes, soccer shoes, football shoes, rugby shoes, baseball shoes, sneakers, hiking boots, sandals, socks, etc.

As used herein, the term "traction surface" refers to a surface that includes one or more traction elements that are configured to provide increased traction between the portion of the article of footwear on which the traction surface is disposed and a ground surface (e.g., the ground). For example, an outsole of an article of footwear can comprise a traction surface configured to increase traction between the article of footwear and the ground surface. In some instances, a traction surface may be in contact (e.g., fully or partially) with the ground surface when a wearer is performing one or more types of movement (e.g., lateral movement) and may not be in contact with the ground surface when the wearer is performing one or more other types of movement (e.g., forward movement). As used herein, a "traction element" or "traction elements" refer to elements disposed on a traction surface such as projections, nubs, grooves, siping, and/or are otherwise textured relative to a relatively smooth or untextured portion of the traction surface. A "non-traction surface" may refer to a surface that does not include any traction elements.

Although the figures may illustrate an article of footwear intended for use on only one foot (e.g., a right foot) of a wearer. One skilled in the art and having the benefit of this disclosure will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

The Disclosed Technology

An article of footwear typically includes two main components: a sole structure and an upper. The sole structure is configured for supporting the wearer's foot and providing cushioning between the wearer's foot and the ground (e.g., the surface on which they are moving, walking, running, etc.). The upper is coupled to the sole structure and forms a foot-receiving cavity. The upper is configured for securing the wearer's foot to the sole structure and/or can protect the wearer's foot.

In use, a wearer's foot may move in different directions and change orientation relative to the ground, thereby changing which surfaces of the article of footwear have contact with the ground during use. For example, the sole structure may comprise an outsole that has an inferior side portion, lateral side portion, and medial side portion. The inferior side portion can extend between the lateral side portion and the medial side portion and can be considered a main, ground-contacting surface (e.g., the "bottom" surface of the outsole which has contact with the ground when the wearer is standing upright with their toes facing forward and heel facing backward).

Traditionally, the inferior side portion of the outsole may have one or more traction surfaces with one or more traction elements that provide increased traction between the article of footwear and the ground. As a result, while moving across the ground, the wearer may be less likely to slip. For athletes, these traction surfaces may provide enhanced traction while moving quickly across the ground, and/or during frequent changes in foot orientation and/or direction of movement. In one example, an athlete (such as a basketball player) may move (e.g., "cut") in a lateral or medial direction, causing one of their feet (e.g., the one farthest away from the direction of movement) to roll in a medial direction, toward the ground. As a result, the medial side portion of the article of footwear, which may include the medial side portion of the outsole, at least a portion of the midsole, and/or at least a portion of the medial side portion of the upper, may come into contact with the ground. However, since the medial side portion of the article of footwear does not typically have traction elements and/or traction surfaces that extend far enough in a superior direction from the inferior side portion of the outsole, over the midsole, and/or over a portion of the upper, the wearer's foot may slip or have reduced traction against the ground. As a result, the wearer's ability to move quickly across the ground may be impaired, thereby impairing their overall athletic performance.

Disclosed herein are articles of footwear that have an outsole with a medial side portion that includes a plurality of portions having different traction elements. As a result, the disclosed articles of footwear and/or outsoles for an article of footwear provide increased traction during use, including during medial rotations of the foot, compared to traditional articles of footwear.

In one representative embodiment, an article of footwear comprises a medial side portion, a lateral side portion, and an outsole extending from the medial side portion to the lateral side portion and configured to contact a ground surface. The outsole may comprise a first portion having a first traction surface configured for engaging the ground surface. The first traction surface may be disposed on the medial side portion and comprise one or more first traction elements. The outsole may further comprise a second portion having a second traction surface configured for engaging the ground surface. The second portion may be disposed on the medial side portion and extend in a superior direction from the first portion. Further, the second traction surface may comprise one or more second traction elements.

In some embodiments, each of the one or more first traction elements has a different shape and size than each of the one or more second traction elements.

In some embodiments, a shape and arrangement of the one or more first traction elements on the first traction surface provides the first traction surface with a first texture and a shape and arrangement of the one or more second traction elements on the second traction surface provides the second traction surface with a second texture, the second texture different than the first texture.

In some embodiments, the one or more first traction elements include a plurality of spaced apart, first raised elements that protrude outward from the first traction surface, the one or more second traction elements include a plurality of spaced apart, second raised elements that protrude outward from the second traction surface, and the plurality of first raised elements have a different shape than the plurality of second raised elements.

In some embodiments, the one or more first traction elements include a plurality of protruding ribs spaced apart from one another and the one or more second traction elements include a plurality of protruding nubs spaced apart from one another, where a surface area of each nub of the plurality of nubs is smaller than a surface area of each rib of the plurality of ribs.

In some embodiments, each rib of the plurality of protruding ribs extends from an anterior-to-posterior direction relative to an anterior end and posterior end of the outsole.

In some embodiments, the first portion includes a curved rim, the second portion includes a complementary, curved, recessed lip, and the curved rim and the recessed lip are adapted to have face-sharing contact with one another and form an overlapping interface between the first portion and the second portion, the overlapping interface separating the first traction surface and second traction surface from one another.

In some embodiments, the first traction surface and the second traction surface are comprised of a same material.

In some embodiments, the first traction surface and the second traction surface are comprised of different materials.

In some embodiments, the article of footwear further comprises a midsole coupled to an interior surface of the outsole. Additionally, in some embodiments, on the medial side portion, proximate to an anterior end of the outsole and in a region of the first traction surface and the second traction surface, the outsole overlaps an entirety of the midsole.

In another representative embodiment, an outsole for an article of footwear comprises a first portion having a lateral side portion, a medial side portion, and an inferior side portion, the inferior side portion extending between the lateral side portion and the medial side portion, the first portion including a first traction surface arranged on the medial side portion and comprising a plurality of first raised elements spaced apart from one another across the first traction surface. The outsole further comprises a second portion fixedly coupled to the first portion and extending in a superior direction from the first portion, the second portion having a second traction surface comprising a plurality of second raised elements spaced apart from one another across the second traction surface, each of the plurality of second raised elements having a different shape than each of the plurality of first raised elements.

In some embodiments, the plurality of first raised elements include a plurality of ribs, each rib of the plurality of ribs having a longer dimension arranged along a direction extending from an anterior end to a posterior end of the outsole.

In some embodiments, the plurality of second raised elements include a plurality of spherical nodes, where the longer dimension of each rib is longer than a longest dimension of each spherical node of the plurality of spherical nodes.

In some embodiments, a surface area of each first raised element of the plurality of first raised elements is larger than a surface area of each second raised element of the plurality of second raised elements.

In some embodiments, each first raised element of the plurality of raised elements extends outward from a base of the first traction surface, in a medial direction that is away from an interior of the outsole and each second raised element of the plurality of raised elements extends outward from a base of the second traction surface, in the medial direction.

In some embodiments, the second portion is fixedly coupled to the first portion via an overlapping interface of the first traction surface and the second traction surface, the overlapping interface comprising a rim arranged on the first portion and a recessed lip arranged on the second portion. In some embodiments, an outer surface of the rim does not include raised elements and an inner surface of the rim is in face-sharing contact with an outer surface of the recessed lip.

In yet another representative embodiment, an article of footwear comprises an upper and a sole structure coupled to the upper. The sole structure comprises a midsole and an outsole having an interior surface coupled to the midsole. The outsole comprises a main portion including a medial side portion, a lateral side portion, and an inferior side portion connecting the medial side portion to the lateral side portion, the medial side portion including a first traction surface including a plurality of first traction elements. The outsole further comprises a supplemental portion fixedly coupled to the main portion at a superior side of the first traction surface and including a plurality of second traction elements, where, on a medial side of the article of footwear, proximate to an anterior end, the first traction surface and the second traction surface of the outsole overlap a medial surface of the midsole and an inferior portion of a medial surface of the upper.

In some embodiments, the plurality of first traction elements are spaced apart from one another and protrude outward, in a medial direction, from a base of the first traction surface, and the plurality of second traction elements are spaced apart from one another and protrude outward, in the medial direction, from a base of the second traction surface. Additionally, in some embodiments, each first traction element of the plurality of first traction elements has a different shape than each second traction element of the plurality of second traction elements.

In some embodiments, on a lateral side of the article of footwear, proximate to the anterior end, only a portion of a non-traction surface, not including traction elements, of the outsole overlaps a lateral surface of the midsole and an inferior portion of a lateral surface of the upper.

In some embodiments, each of the first traction surface and the second traction surface extend along the medial side portion from the anterior end to an arch region arranged between the anterior end and a posterior end of the article of footwear and the supplemental portion is fixedly coupled to the main portion via an overlapping interface arranged between the first traction surface and the second traction surface.

Additional examples of the disclosed technology are described below with reference to the accompanying drawings.

Exemplary Embodiments of the Disclosed Technology

Figure 2:
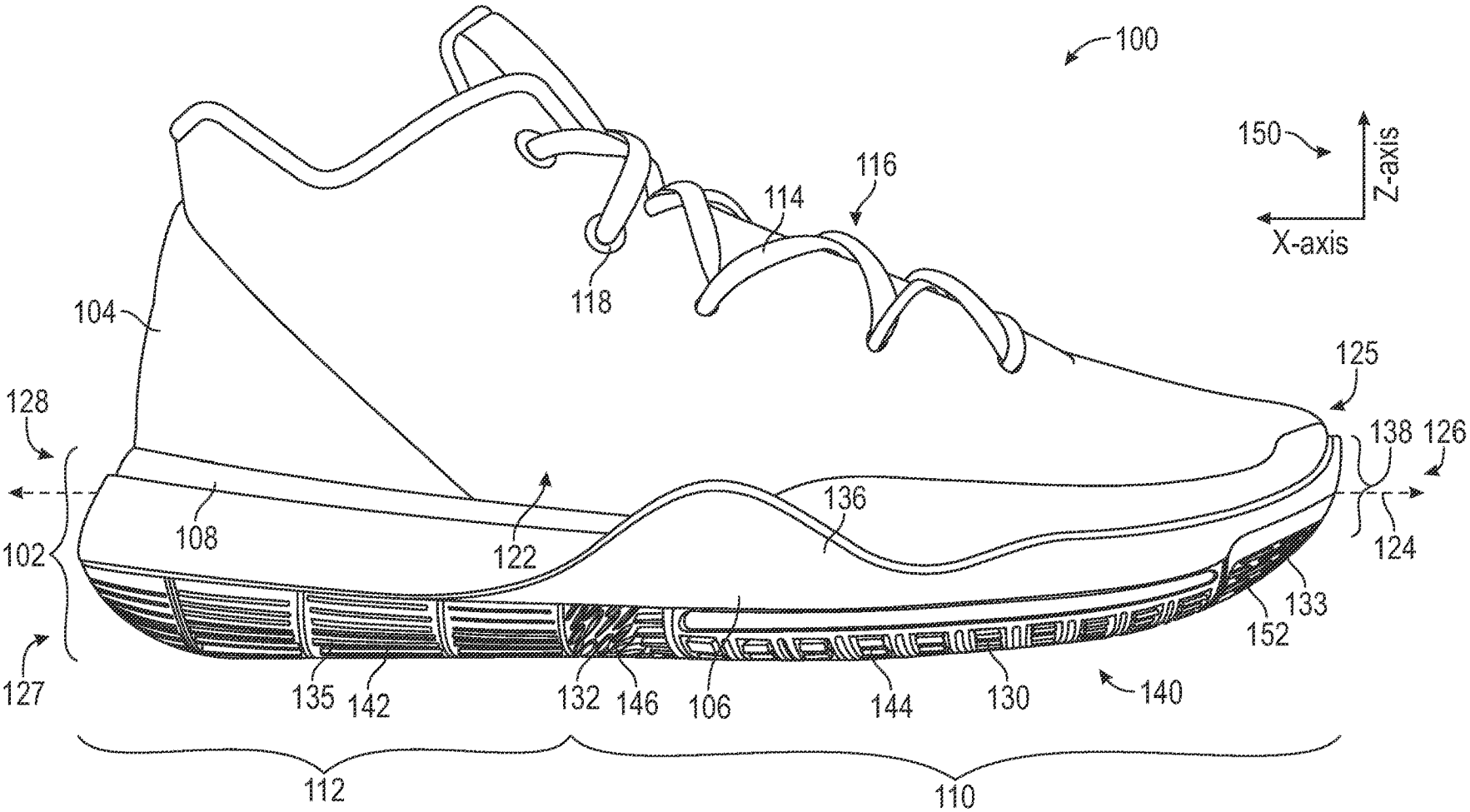
FIG. 2 is a lateral side view of the article of footwear.
Figure 3:
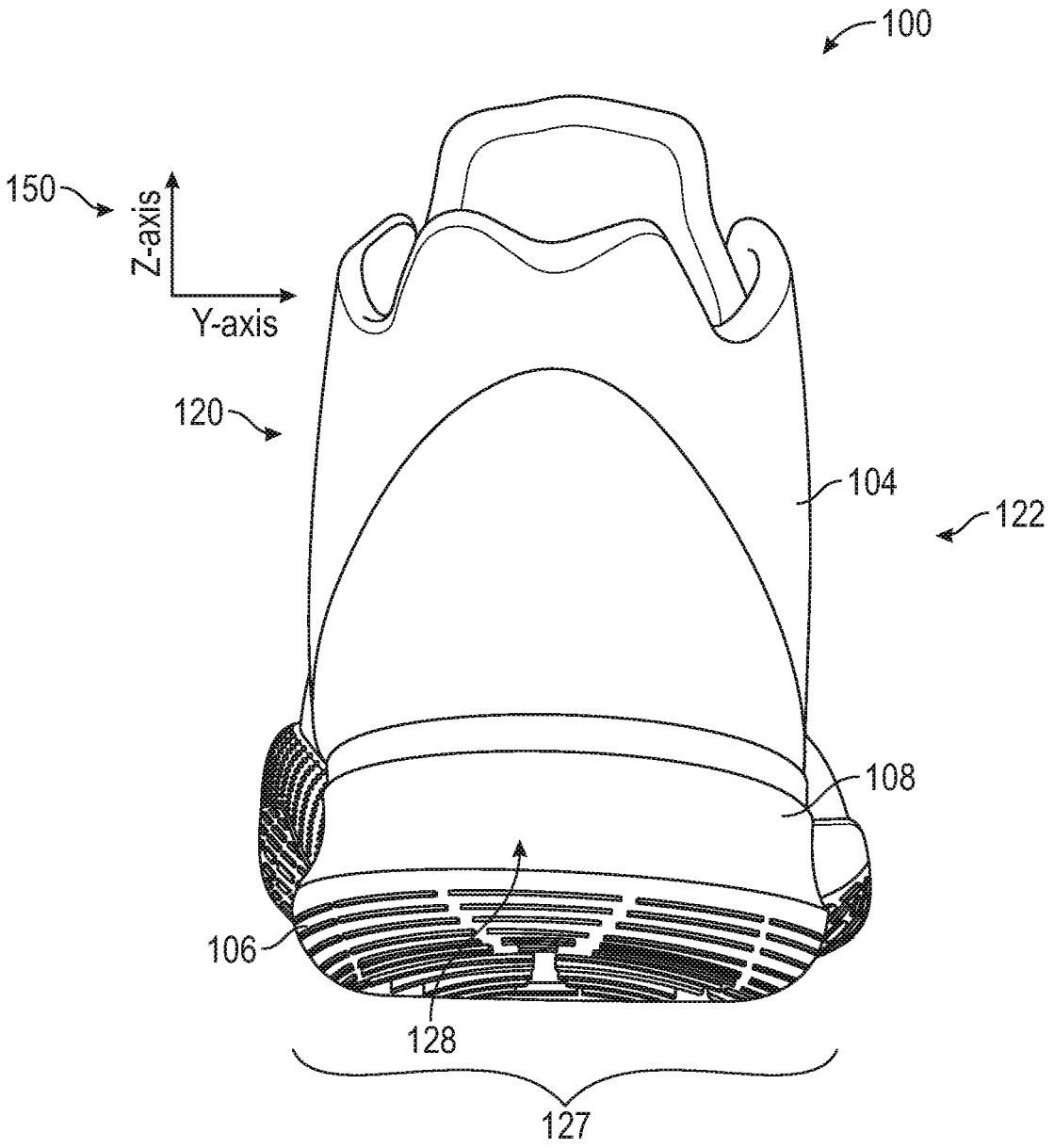
FIG. 3 is a rear view of the article of footwear.

FIGS. 1-3 show an article of footwear 100. The article of footwear 100 includes a medial side and lateral side and comprises two main components: a sole structure 102 and an upper 104. The upper 104 is coupled to the sole structure 102. The sole structure 102 includes an outsole 106 and a midsole 108. The outsole 106 can be configured with one or more traction surfaces and/or can be configured to cover and/or protect at least a portion of the midsole 108 and/or the upper 104. The midsole 108 can be disposed between the upper 104 and the outsole 106 and can be configured to provide cushioning. The upper 104 can be coupled to the midsole (e.g., via a strobel). As discussed further herein, certain portions of the outsole 106, such as a medial side portion, may include one or more traction surfaces that extend further in a superior direction to cover a portion of the midsole 108 and/or upper 104, thereby providing increased traction to the medial side of the article of footwear 100 when the wearer's foot rolls onto the medial side.

More specifically, FIG. 1 shows a medial side view of the article of footwear 100, FIG. 2 shows a lateral side view of the article of footwear 100, and FIG. 3 shows a rear view of the article of footwear 100. FIGS. 1-3 include reference axes 150 having an x-axis, y-axis, and z-axis. As referred to herein, a superior-to-inferior direction is arranged along the z-axis, an anterior-to-posterior direction is arranged along the x-axis, and a medial-to-lateral direction is arranged along the y-axis.

The article of footwear 100 includes a medial side portion (e.g., medial side) 120 (shown in FIG. 1) and a lateral side portion (e.g., lateral side) 122 (shown in FIG. 2) arranged opposite one another across a longitudinal axis 124 of the article of footwear 100. The article of footwear 100 further includes a toe portion 125 arranged at an anterior end 126 of the article of footwear 100 and a heel portion 127 arranged at a posterior end 128 of the article of footwear 100. The medial side portion 120 may extend between the toe portion 125 and heel portion 127 and face a medial anatomical direction (e.g., toward a midline of the wearer) when the article of footwear 100 is being worn by the wearer. The lateral side portion 122 may also extend between the toe portion 125 and heel portion 127, but faces a lateral anatomical direction (e.g., away from the midline of the wearer) when the article of footwear 100 is being worn by the wearer.

As shown in FIGS. 1-3, the article of footwear 100 comprises two main components: the sole structure 102 and the upper 104. The upper 104 is coupled to the sole structure 102 so as to form a foot-receiving cavity between the sole structure 102 and the upper 104. For example, the upper 104 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. The upper 104 shown in FIGS. 1-3 includes a lacing region 116, which includes apertures 118 (e.g., eyelets) for receiving a lace 114 that can be tightened to close the upper 104 around a foot. The upper 104 may alternatively implement any of a variety of other configurations, materials, and/or closure mechanisms (e.g., straps, etc.).

The article of footwear 100 may be segmented into an anterior portion 110 and a posterior portion 112, as noted in FIGS. 1-2. The anterior portion 110 is arranged closer to the anterior end 126 of the article of footwear 100 than the posterior portion 112. Likewise, the posterior portion 112 is arranged closer to the posterior end 128 of the article of footwear 100 than the anterior portion 110. The demarcation between the anterior portion 110 and posterior portion 112 may be at a region of a medial arch of the outsole 106 (e.g., medial arch region 113, as shown in FIG. 1).

The medial side portion 120 of the article of footwear 100 includes medial side portions of each of the upper 104, the midsole 108, and/or the outsole 106, and the lateral side portion of the article of footwear 100 includes lateral side portions of each of the upper 104, the midsole 108, and/or the outsole 106, as noted further below.

As shown in FIG. 1, on the medial side portion 120 of the article of footwear 100, at the anterior portion 110, the outsole 106 wraps upward, in a superior direction, and around at least a portion of the midsole 108 and at least a portion of the upper 104. As such, the outsole 106 at least partially overlaps the bite line (i.e., where the midsole 108 and the upper 104 meet). Also on the medial side portion 120, at the posterior portion 112, the outsole 106 is coupled to an inferior side of the midsole 108 and the midsole 108 is positioned between (and separates) the outsole 106 and the upper 104. Thus, at the posterior portion 112, the outsole 106 does not overlap the upper 104. Similarly, on the heel portion 127 of the article of footwear 100, as shown in FIG. 3, the midsole 108 separates the outsole 106 from the upper 104 and the outsole 106 does not overlap the upper 104.

As shown in FIG. 2, on the lateral side portion 122 of the article of footwear 100, at the anterior portion 110, the outsole 106 wraps upward, in the superior direction, and around a portion (e.g., inferior portion) of the midsole 108 and a portion of the more inferior portion of the upper 104, but only at an anterior end of the anterior portion 110. Specifically, as seen in FIG. 2, the outsole 106 overlaps a portion of the upper 104 at a more middle-portion of the lateral side portion 122 of the article of footwear 100, proximate to where the anterior portion 110 meets the posterior portion 112. However, the outsole 106 does not overlap the upper 104 or a more superior portion of the midsole 108 in a middle region of the anterior portion 110. This is in contrast to the medial side portion 120 in which the outsole 106 overlaps a greater portion of the midsole 108 and the upper 104, as discussed above with reference to FIG. 1. As discussed further below, the outsole 106 with one or more traction surfaces disposed on the medial side portion 120, which can overlap a portion of the midsole 108 and the upper 104 can, for example, increase traction between the article 100 and the ground when at least a portion of the medial side portion 120 of the article comes into contact with the ground.

As shown in FIGS. 1-2, the surfaces of the outsole 106 on the medial side portion 120 and lateral side portion 122 are different and have different traction elements (e.g., different amounts of traction surfaces and different shape, number, and/or orientation of traction elements on the traction surfaces, etc.). For example, as shown in FIG. 2, surfaces of the outsole 106 disposed at least partially on the lateral side portion 122 include a first traction surface 130, a second traction surface 132, a third traction surface 133, and a fourth traction surface 135 arranged on an inferior side portion 140 of the outsole 106 and a fifth surface 136 disposed on a superior portion 138 of the outsole 106. The first traction surface 130, second traction surface 132, third traction surface 133, and fourth traction surface 135 may continue from the lateral side portion of the outsole 106 to one or more other portions of the outsole 106 (e.g., the inferior side portion, the heel portion 127, and/or the medial side portion 120).

When the article of footwear is resting on the ground (e.g., ground surface), as shown in FIGS. 1-3, the inferior side portion 140 may be generally directed toward the ground surface and in the x-y plane of reference axes 150.

The fifth surface 136 extends in the superior direction from each of the first traction surface 130, second traction surface 132, and third traction surface 133. As shown in FIG. 2, the fifth surface 136 does not include any traction elements, and thus may be a relatively smooth surface (e.g., without raised elements, protruding elements, or texture that provides increased traction relative to a smooth surface). The fifth surface 136 includes an undulating rim disposed on its outer, superior edge which contacts portions of the midsole 108 and/or upper 104. However, in alternate embodiments, the fifth surface 136 may not include an undulating rim and, for example, the rim may be relatively straight or curved.

In contrast to the relatively smooth fifth surface 136, as shown in FIG. 2, the first traction surface 130 includes a plurality of first traction elements 144 which may be raised traction elements that protrude outward (in the lateral direction) from a base (and relatively smooth) surface of the first traction surface 130. Similarly, as shown in FIG. 2, the second traction surface 132 includes a plurality of second traction elements 146, the third traction surface 133 includes a plurality of third traction elements 152, and the fourth traction surface 135 includes a plurality of fourth traction elements 142.

It should be noted that FIGS. 1-3, as described above and further below, show one possible embodiment for the outsole 106, including one possible embodiment for the configuration of the various surfaces of the outsole 106. In alternate embodiments, the various traction surfaces described above, arranged on the lateral side portion 122, may have traction elements of different sizes, shapes, numbers, or arrangements than those shown. Further, in alternate embodiments, the outsole 106 may include more or less traction surfaces and/or non-traction surfaces than those described above and shown in FIG. 2. For example, there could be various other possible configurations for the surfaces of the outsole 106, based on the intended ground surface or use of the wearer. For example, the surfaces of the outsole (e.g., number, size, and arrangement of traction and non-traction surfaces) may be configured differently for different activities (e.g., basketball, tennis, volleyball, etc.). The outsole 106 described herein may be one possible configuration for an outsole for an article of footwear for basketball.

Returning to FIG. 2, the first traction surface 130, second traction surface 132, third traction surface 133, and fourth traction surface 135 extend only a small amount onto the lateral side portion 122 from the inferior side portion 140.

In contrast, as shown in FIG. 1 and introduced above, traction surfaces of the outsole 106 disposed on the medial side portion 120 extend by a larger amount (in the superior direction) onto the medial side portion 120 from the inferior side portion 140. This can, for example, provide a wearer with increased traction when making lateral movements where at least a portion of the medial side portion 120 contacts the ground. As shown in FIG. 1, these traction surfaces of the outsole 106 disposed on the medial side portion 120 can include a plurality of traction surfaces, including: first traction surface 160 and second traction surface 162. Each of the first traction surface 160 and the second traction surface 162 have different traction elements. For example, as explained further below, the traction elements of the first traction surface 160 may have a different size, shape, and/or texture from the traction elements of the second traction surface 162. As shown in FIG. 1, together, the first traction surface 160 and the second traction surface 162 of the outsole 106 overlap a medial surface of the midsole 108 and an inferior portion of a medial surface of the upper 104. Further details on the first traction surface 160 and second traction surface 162 of the outsole 106 are discussed below with reference to FIGS. 4-11.

Though the outsole 106 is depicted as having two traction surfaces (first traction surface 160 and second traction surface 162) disposed on the medial side portion 120, which extend further in the superior direction to overlap portions of the midsole 108 and upper 104, in alternate embodiments, this medial side portion of the outsole 106 may include more than two tractions surfaces (e.g., three, four, etc.). For example, in some embodiments, the first traction surface 160 and the second traction surface 162 may be replaced by three or four traction surfaces arranged adjacent to one another or combined with an additional, adjacently arranged, traction surface (or traction surfaces).

Turning now to FIGS. 4-11, different views of the outsole 106, removed from a remainder of the article of footwear 100, are shown. Though FIGS. 1-3 depict the outsole 106 attached to the upper 104 and midsole 108 of the article of footwear 100, in some embodiments, the outsole 106 described further below with reference to FIGS. 4-11 may be attached to a different upper and/or midsole. For example, in some embodiments, the outsole 106 may be attached to an upper configured for a different sport (other than basketball), such as tennis, soccer, volleyball, etc.

Figure 9:
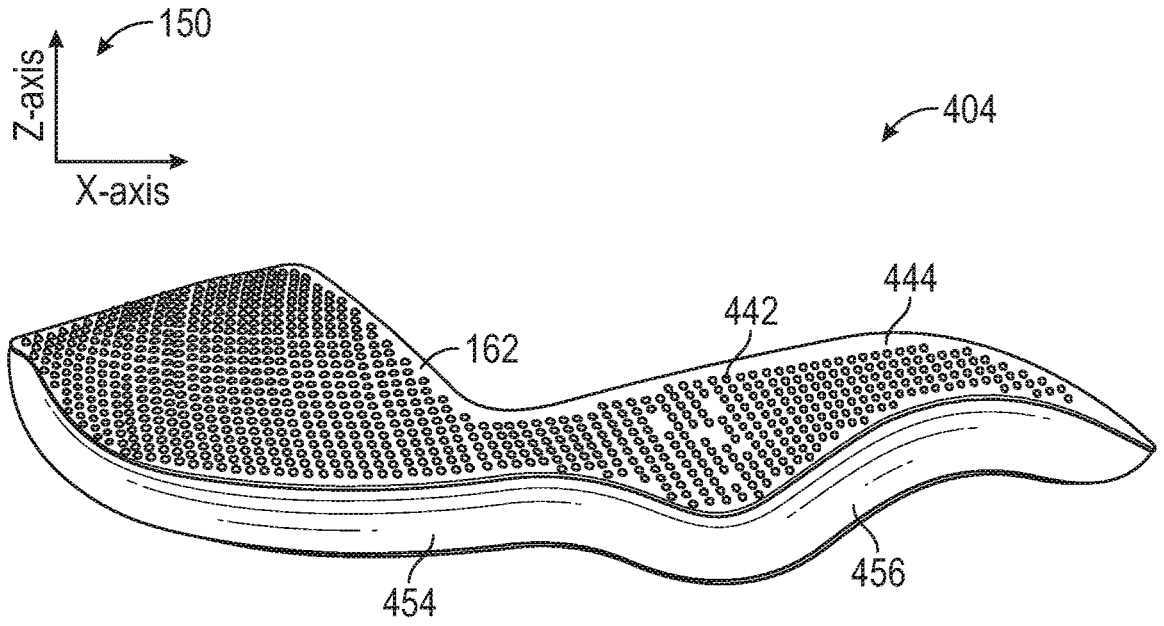
FIG. 9 is a perspective view of a supplemental portion of the outsole.
Figure 10:
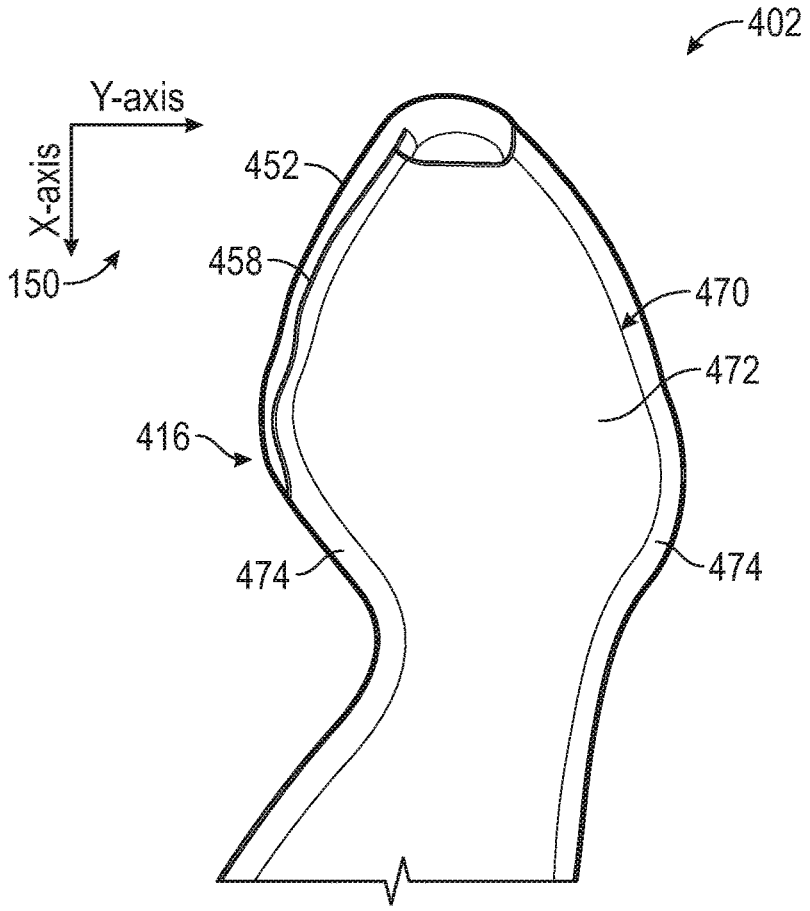
FIG. 10 is a partial top, interior view of a main portion of the outsole.
Figure 11:
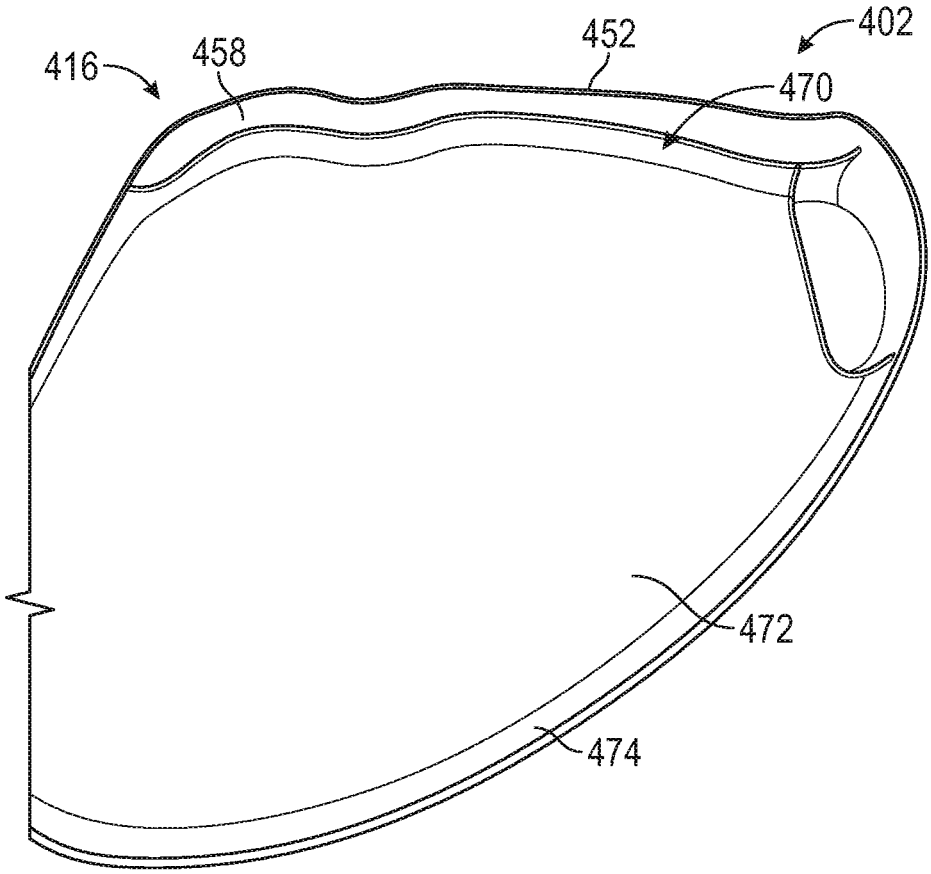
FIG. 11 is a detail view of the top, interior view of the main portion of the outsole.

The outsole 106 includes a main portion (also referred to herein as a first portion) 402 and a supplemental portion (also referred to herein as a second portion) 404. The fully assembled outsole 106, with the main portion 402 and supplemental portion 404 fixedly coupled to one another, is shown in FIGS. 4-8. FIG. 9 shows a detail view of only the supplemental portion 404, and FIGS. 10-11 show views of only the main portion 402. FIGS. 4-10 also include reference axes 150.

The main portion 402 of the outsole 106 is configured for supporting the wearer's foot and providing cushioning between the wearer's foot and the ground. As explained further below, the main portion 402 may include medial, lateral, posterior, and anterior side portions that extend in the superior direction from an inferior side portion, thereby be adapted to wrap around a portion of and provide support to the wearer's foot. The main portion 402 may serve as a primary interface with the ground, and the supplemental portion 404 may provide additional traction on the medial side portion of the article of footwear.

Figure 4:
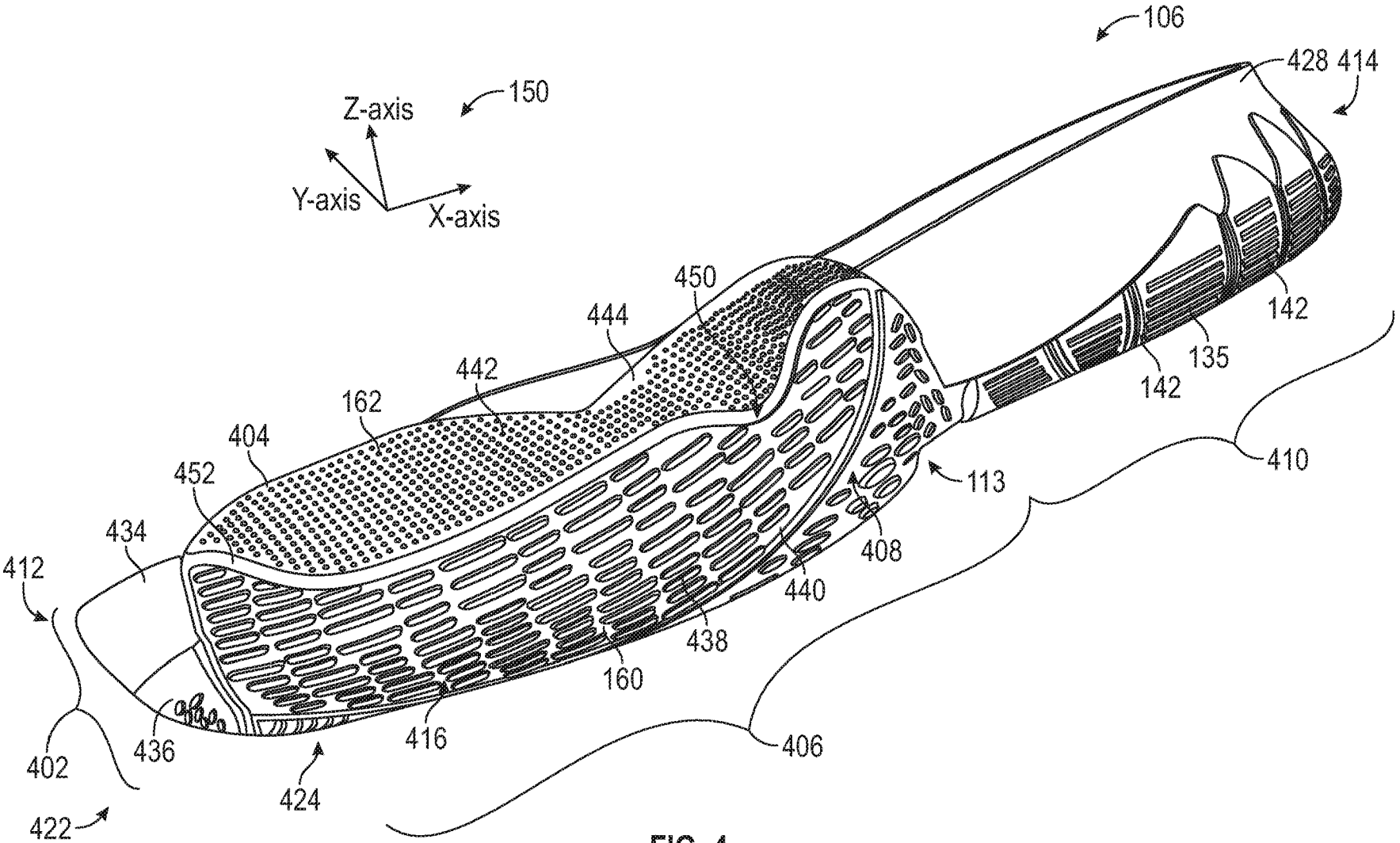
FIG. 4 is a perspective view of an outsole for an article of footwear.
Figure 5:
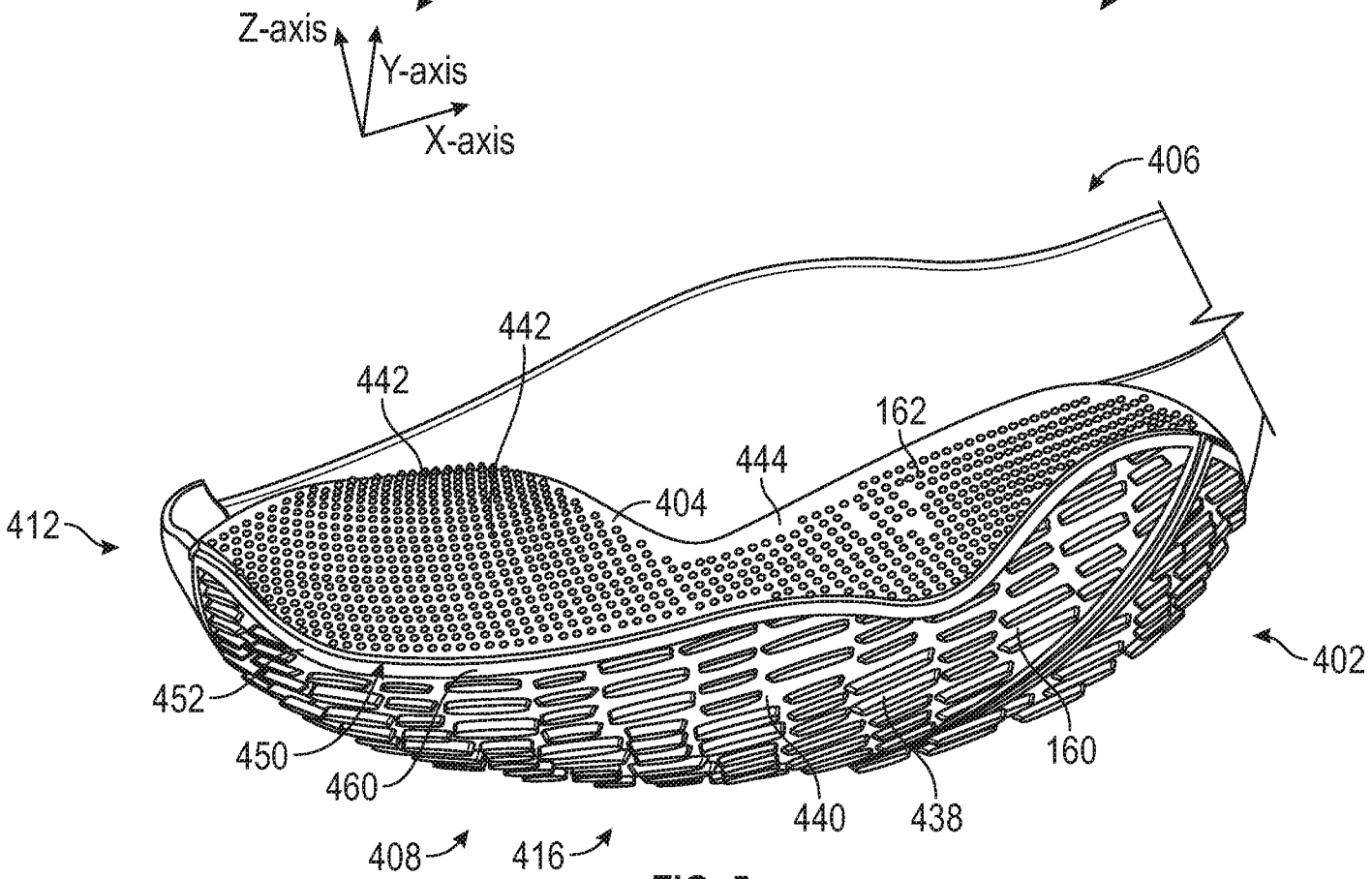
FIG. 5 is a detail view of the outsole, showing a medial side portion of the outsole proximate to an anterior end of the outsole.
Figure 6:
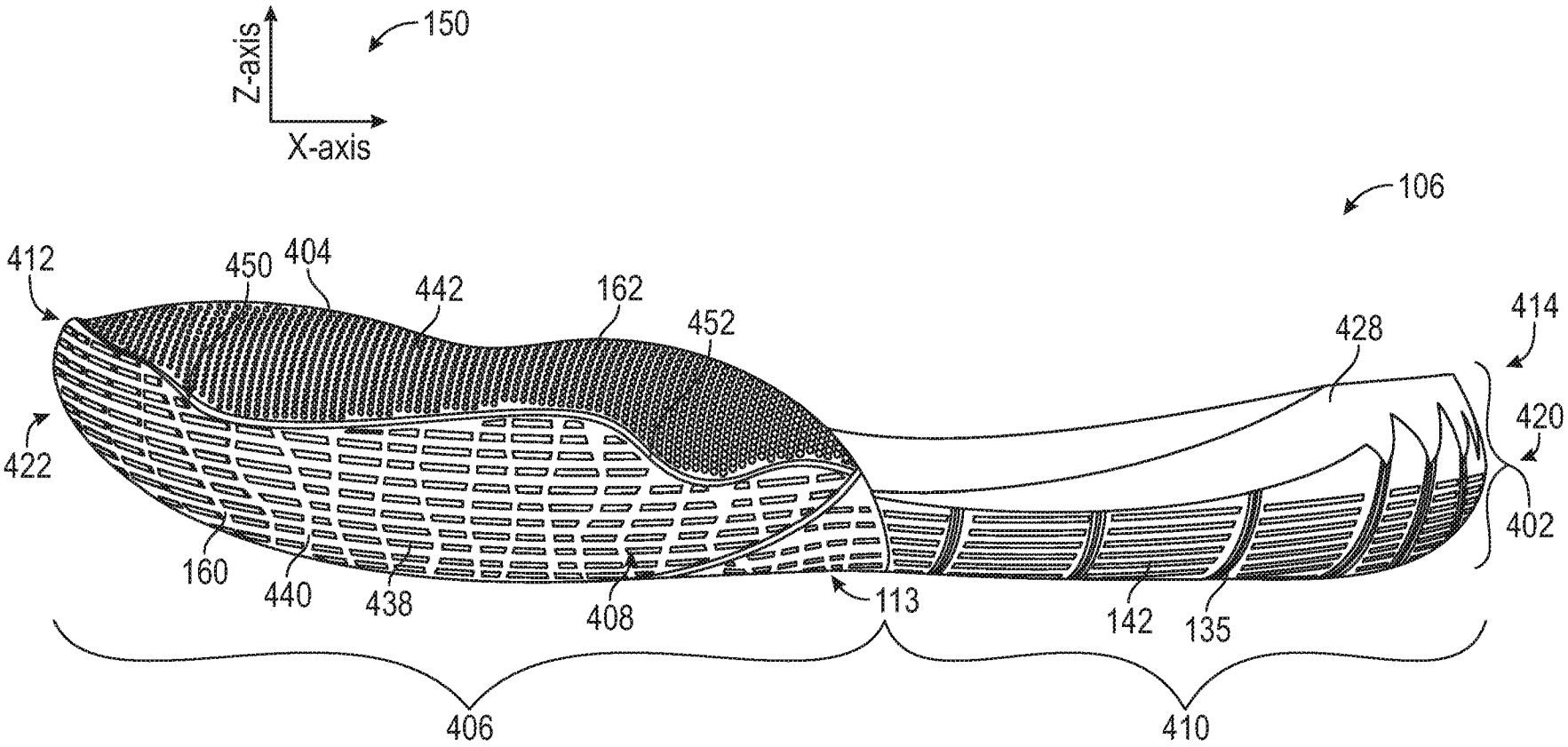
FIG. 6 is a side view of the medial side portion of the outsole.
Figure 7:
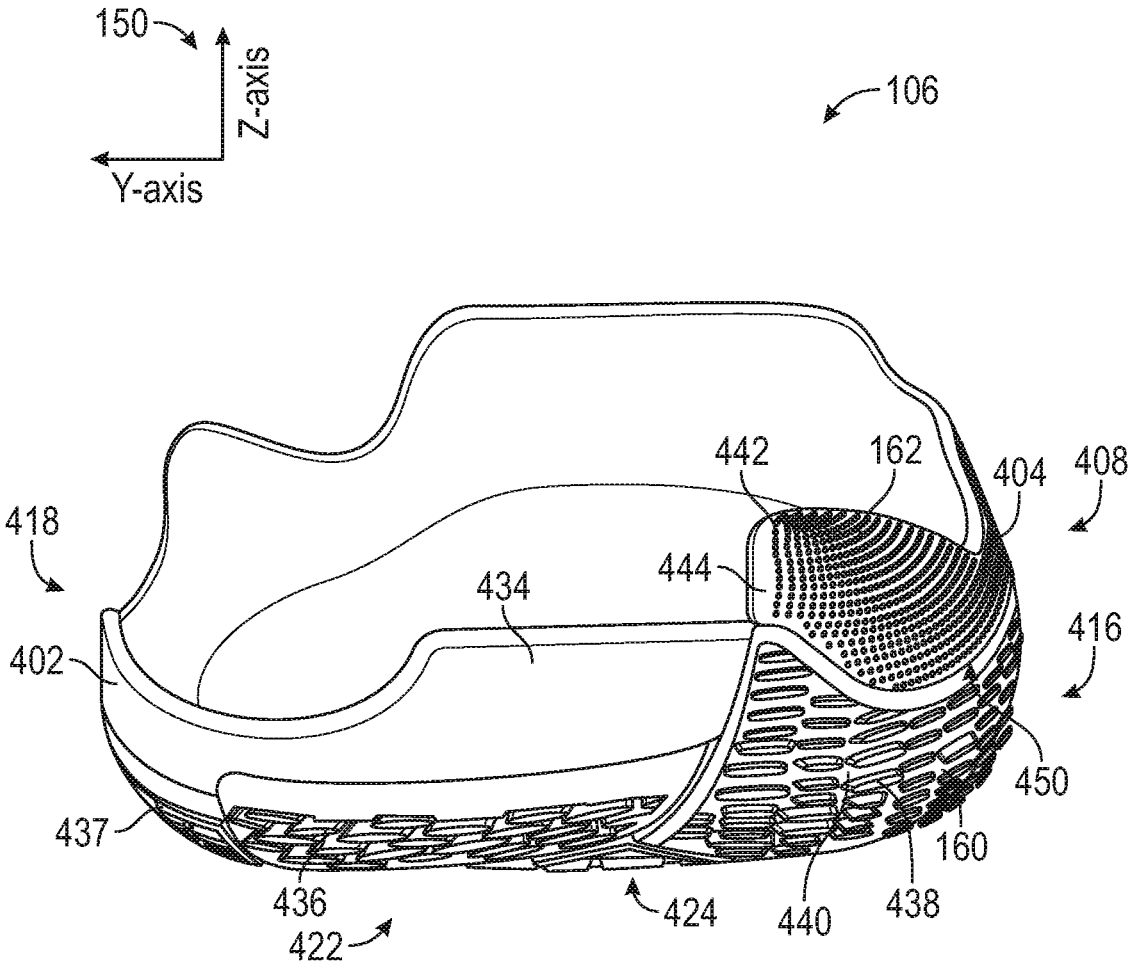
FIG. 7 is a front view of the outsole.
Figure 8:
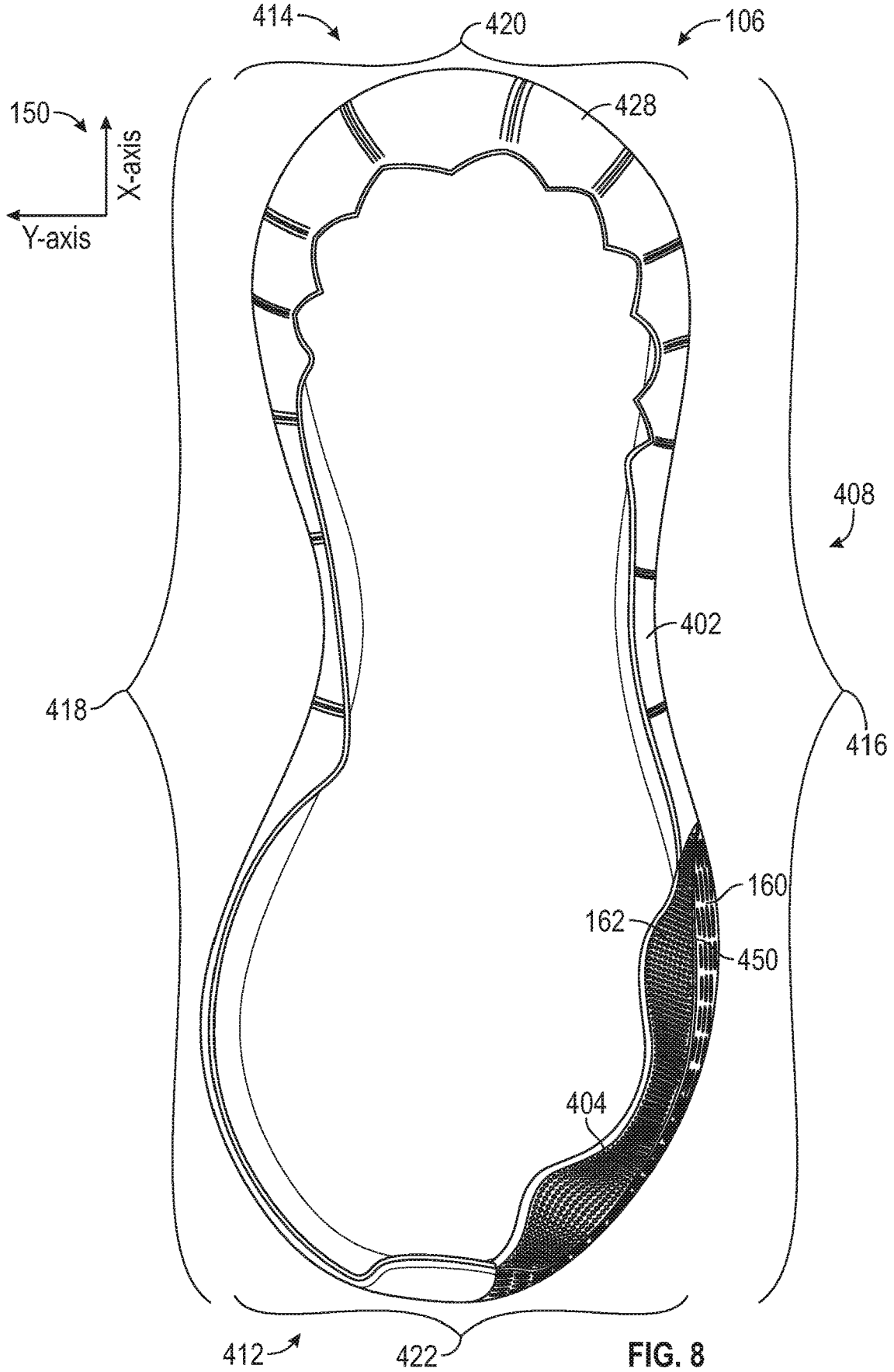
FIG. 8 is a top view of the outsole.

Turning first to FIGS. 4-8, the assembled outsole 106 is shown in a perspective view in FIG. 4, a side view in FIG. 6, a front view in FIG. 7, and a top view in FIG. 8. FIG. 5 shows a more detailed view of an anterior portion 406 of a medial side portion 408 of the outsole 106. As introduced above, the outsole 106 comprises the main portion 402 and the supplemental portion 404, where the supplemental portion 404 is fixedly coupled to the main portion 402. In the illustrated embodiment, the main portion 402 extends, in an anterior-to-posterior direction arranged along the x-axis, from an anterior end 412 of the outsole 106 (which may correspond to the anterior end 126 of the article of footwear of FIGS. 1-3) to a posterior end 414 of the outsole 106 (which may correspond to the posterior end 128 of the article of footwear 100 of FIGS. 1-3) and extends, in a medial-to-lateral direction arranged along the y-axis, from a medial side to a lateral side of the outsole 106. The supplemental portion 404 extends from the anterior end 412 to a portion of the outsole 106 arranged between the anterior end 412 and posterior end 414 (e.g., approximately to the medial arch region 113) and is only arranged on the medial side portion 408 of the outsole 106. In other embodiments, the main portion 402 and the supplemental portion 404 can extend over a greater or lesser portion of the article than shown in the illustrated embodiment. For example, in some embodiments, the supplemental portion 404 may extend further in the posterior direction, toward the posterior end 414, and/or not as far in the anterior direction, toward the anterior end 412.

The main portion 402 of the outsole 106 comprises a medial side portion 416 (which is part of the medial side portion 408 of the outsole 106), a lateral side portion 418 (as seen in FIGS. 7-8), a posterior side portion 420 (as seen in FIGS. 6-8), an anterior side portion 422 (as seen in FIG. 7), and an inferior side portion 424 (as seen in FIG. 4). The inferior side portion 424 corresponds to (e.g., may be the same as) the inferior side portion 140 of the outsole 106 and extends between the medial side portion 416 and the lateral side portion 418. The inferior side portion 424 may be a "bottom" side of the main portion 402 of the outsole, relative to the ground surface on which a wearer of the article of footwear may be standing. As indicated by reference axes 150, the inferior side portion 424 is arranged in an x-y plane, formed by the x-axis and y-axis.

The main portion 402 includes a plurality of surfaces having different textures and/or traction elements. As introduced above, the medial side portion 416 of the main portion 402 includes the first traction surface 160 and the main portion 402 may include one or more additional traction and/or non-traction surfaces. For example, in one embodiment, the main portion 402 may additionally include the first traction surface 130, second traction surface 132, third traction surface 133, fourth traction surface 135, and a fifth surface 136 (as discussed above with reference to FIG. 2). The first traction surface 130, second traction surface 132, third traction surface 133, and fourth traction surface 135, arranged at least partially on the lateral side portion 418, may continue, in an inferior direction, onto (e.g., wrap around onto) the inferior side portion 424 of the main portion 402 of the outsole 106.

As seen in FIGS. 4, 6, and 8, the main portion 402 further includes a sixth surface 428. The sixth surface and/or the fourth traction surface 135 may be disposed on each of and wrap around from the medial side portion 416, across the posterior side portion 420, and to the lateral side portion 418. The sixth surface 428 extends away, in the superior direction, from the fourth traction surface 135. The sixth surface 428 may be relatively smooth and not include any traction elements. In contrast, the fourth traction surface 135 includes the plurality of fourth traction elements 142 which may include some traction elements that extend in a first direction (e.g., the anterior-to-posterior direction when they are disposed on the medial or lateral side portions or the medial-to-lateral direction when they are disposed on the posterior side portion) and other traction elements that extend in a second direction (e.g., inferior-to-superior direction, in a direction of the z-axis), where the first and second directions are arranged substantially perpendicular to one another. Each of the fourth traction elements 142 may be spaced apart from one another and protrude outward from a base surface of the fourth traction surface 135. As shown in FIGS. 4 and 6, the fourth traction elements 142 may be elongate ribs of varying lengths. However, in alternate embodiments, the fourth traction elements 142 may have different sizes and/or shapes than those shown in FIGS. 4 and 6 and/or the spacing and numbers of each of the tractions elements of the fourth traction surface 135 may vary.

In alternate embodiments, the sixth surface 428 may be part of the fourth traction surface 135 and/or include one or more traction elements. In some embodiments, the fourth traction surface 135 may extend further in the superior direction than shown in FIGS. 4 and 6 and may include fewer traction elements on the surface as it extends further in the superior direction.

As seen in FIGS. 4 and 7, the first traction surface 160 is disposed on the medial side portion 416 of the main portion 402, but also wraps around to the anterior side portion 422. In this way, the first traction surface 160 makes up a portion of the anterior side portion 422 (see FIG. 7). In some embodiments, the first traction surface 160 may not wrap around to the anterior side portion 422 and/or the first traction surface 160 may wrap around to the anterior side portion 422 to a lesser extent than shown in FIGS. 4 and 7. For example, in some embodiments, the first traction surface 160 (and/or the second traction surface 162) may not extend all the way to a toe portion of the outsole 106.

As shown in FIG. 7, the anterior side portion 422 further includes an upper anterior surface 434 (which, in one embodiment, may be continuous with or part of the fifth surface 136 shown in FIG. 2), a lower anterior surface 436 (which, in one embodiment, may be continuous with or part of the third traction surface 133 shown in FIG. 2), and a lower lateral traction surface 437 (which may be the same as the first traction surface 130 shown in FIG. 2). While the upper anterior surface 434, lower anterior surface 436, and lower lateral traction surface 437 are examples of additional surfaces of the main portion 402, other configurations of the surfaces of the main portion 402 on the anterior side portion 422, in addition to the first traction surface 160, may be possible.

As also seen in FIGS. 4, 6, and 7, the supplemental portion 404 extends in the superior direction (in the direction of the z-axis) from the first traction surface 160 of the main portion 402. The second traction surface 162 of the supplemental portion 404 extends, in the superior direction, by the greatest amount in a region of the outsole 106 that is on the medial side portion 416, proximate to the anterior end 412. As seen in FIG. 7, a height of the outsole 106 is highest in the region of the first traction surface 160 and the second traction surface 162, at an interface between the medial side portion 416 and the anterior side portion 422. In alternate embodiments, the height of the outsole 106 may be highest in the region of the first traction surface 160 and the second traction surface 162, at a different position on the outsole, such as further back, in the posterior direction, on the medial side portion 416 (and not to the anterior side portion 422).

As shown in FIGS. 4-7, the first traction surface 160 includes a plurality of first traction elements 438. In some embodiments, the first traction surface 160 may include one or more first traction elements 438. In other embodiments, the first traction surface 160 may include at least two first traction elements 438. The first traction elements 438 may include a plurality of spaced apart, first raised elements, that protrude outward from a base 440 of the first traction surface 160. The base 440 may be a relatively smooth surface that is recessed, in a direction toward an interior of the outsole 106, relative to the raised, first traction elements 438. Thus, the raised, first traction elements 438 may extend outward from the base 440, in a direction away from the interior of the outsole 106. In this way, the raised, first traction elements 438 provide a first texture for the first traction surface 160. As shown in FIGS. 4-7, the first traction elements 438 include a plurality of ribs (e.g., elongate ribs) that are spaced apart from one another and protrude outward from the base 440. In some embodiments, each elongate rib has a longer dimension and a shorter dimension (e.g., the elongate ribs are not square). The longer dimension of each rib extends from an anterior-to-posterior direction on the medial side portion 416 and extends in a direction that follows a radius of curvature from the medial side portion 416 to the anterior side portion 422, as the first traction surface 160 curves around to the anterior side portion 422 from the medial side portion 416. Said another way, the longer dimension of each rib extends in a direction that is perpendicular to the z-axis (and an inferior-to-superior direction). The shorter dimension of each rib extends in the direction of the z-axis. In one embodiment, the longer dimension of each rib may be the same length for each first traction element 438. In another embodiment, the length of the longer dimension of each rib (e.g., first traction element 438) may vary such that the length of the longer dimension of at least one rib is different than another rib of the first traction elements 438. Each first traction element 438 may be spaced apart from adjacent first traction elements 438 on all sides (e.g., on each of its two longer sides and each of is two shorter sides). The spacing (e.g., gap) between adjacent first traction elements 438 may be the same (in one embodiment) or different (in another embodiment) for different pairs of adjacently arranged first traction elements 438 across the first traction surface 160. The first traction elements 438 may also be referred to as blades having a major axis (e.g., longer dimension) and minor axis (e.g., shorter dimension), where the major axis of each rib is arranged perpendicular to the z-axis.

As introduced above, the first traction elements 438 of the first traction surface 160 may have a different size, shape, geometry, and/or texture than second traction elements 442 of the second traction surface 162 of the supplemental portion 404. In one embodiment, the second traction surface 162 may include one or more second traction elements 442. In another embodiment, as shown in FIGS. 4-9, the second traction surface 162 includes at least two second traction elements 442. As seen in the detail view of FIG. 5, the second traction elements 442 include a plurality of spaced apart, second raised elements that protrude outward from a base 444 of the second traction surface 162. The base 444 may be a relatively smooth surface recessed, in a direction toward the interior of the outsole 106, relative to the raised, second traction elements 442. Thus, the raised, second traction elements 442 may extend outward from the base 444, in a direction away from the interior of the outsole 106. In this way, the raised, second traction elements 442 provide a second texture for the second traction surface 162, which is different than the first texture of the first traction surface 160, as explained further below. Having adjacently arranged traction surfaces (e.g., first traction surface 160 and second traction surface 162) with different textures (provided by differently shaped traction elements) on the medial side portion of the outsole may provide increased traction to the article of footwear including the outsole when a wearer turns their foot medially, as explained further below with reference to FIG. 13.

As shown in FIGS. 4-9, the second traction elements 442 include a plurality of protruding nubs that are spaced apart from one another and protrude outward from the base 444. In some embodiments, the protruding nubs (second traction elements 442) may be spherical nodes where a longest dimension of each spherical node is shorter than the longer dimension of each rib of the first traction elements 438. The second traction elements 442 may have a dome-like shape that extends outward from the base 444. As seen in FIG. 5, a surface area of each first raised element of the plurality of first traction elements 438 is larger than a surface area of each second raised element of the plurality of second traction elements 442. Thus, in some embodiments, the second traction surface 162 may have a larger number of traction elements per unit of surface area than the first traction surface 160. The spacing between adjacent second traction elements 442 may be the same (in one embodiment) or different (in another embodiment). In another example, the arrangement of second traction elements 442 across the second traction surface 162 may be regular (e.g., with a same spacing between adjacent second traction elements) or irregular (e.g., with different portions of the second traction surface having more or less traction elements than other portions of the second traction surface). In one embodiment, the amount by which the first traction elements of the first traction surface 160 and the second traction elements of the second traction surface 162 protrude outward from their respective bases may be the same. In an alternate embodiment, the amount by which the first traction elements 438 protrude outward from the base 440 may be greater or less than the amount by which the second traction elements 442 protrude outward from the base 444.

The outsole 106 may be comprised of a polymeric material. In one embodiment, the entire outsole 106 may be comprised of the same polymeric material, but with different textures at different portions of the outsole 106, as described above. For example, in this embodiment, the first traction surface 160 and the second traction surface 162 are comprised of a same, polymeric material. In another embodiment, the outsole 106 may be comprised of a plurality of polymeric materials. For example, different portions of the outsole 106 may be comprised of different polymers. As an example, the entire main portion 402 (and thus the first traction surface) may be comprised of a first polymer while the supplemental portion 404 (and thus the second traction surface) may be comprised of a different, second polymer. In this embodiment, the different polymers may provide different amounts of support and/or different traction properties. As an example, the supplemental portion 404 may be comprised of a less rigid polymer than the main portion 402 since it provides less support to a wearer's foot bed.

In some embodiments, the main portion 402 and the supplemental portion 404 may be fixedly coupled to one another. For example, in certain embodiments, the main portion 402 and the supplemental portion 404 can comprise an overlapping interface 450. This overlapping interface 450 may be seen in greater detail in FIG. 5 (also seen in FIGS. 4, 6, and 7). Referring to FIGS. 5 and 9-11, the overlapping interface 450 comprises a rim 452 arranged adjacent (and directly connected) to a superior side of the first traction surface 160 on the main portion 402 and a recessed lip (e.g., shoulder) 454 arranged adjacent (and directly connected) to an inferior side of the second traction surface 162 on the supplemental portion. The mating surfaces of the rim 452 and the recessed lip 454 are complementary to one another.

In some embodiments, the rim 452 and the recessed lip 454 are curved surfaces that oscillate (e.g., undulate) along a length of the overlapping interface 450 which extends along an entire length of the anterior portion 406 of the medial side portion 408 of the outsole 106. For example, the rim 452 and the recessed lip 454 undulate in a substantially anterior-to-posterior direction from the anterior end 412 of the outsole 106 to a location on the medial side portion 408 that is between the anterior end 412 and the posterior end 414, where the first traction surface 160 and second traction surface 162 terminate. As seen in FIG. 5, the rim 452 protrudes outward, in a direction away from the interior of the main portion 402 of the outsole 106, relative to the base 440 of the second traction surface. Thus, the rim 452 may be raised (or elevated), in the medial direction, from both the base 440 of the first traction surface 160 and the base 444 of the second traction surface 162. Additionally, as shown in FIG. 5, an outer surface 460 of the rim 452 is relatively smooth and without traction elements. As such, the outer surface 460 may provide a break or interface between the first traction elements 438 and the second traction elements 442.

Turning to FIG. 9, the supplemental portion 404 is shown alone, detached from the main portion 402. As such, the recessed lip 454 may be seen in FIG. 9. The recessed lip 454 is depressed inward, toward the interior of the outsole 106, relative to the second traction surface 162. An outer surface 456 of the recessed lip 454 is adapted to mate and have face-sharing contact with an inner surface 458 (shown in FIGS. 10 and 11, as described further below) of the rim 452 when the main portion 402 and supplemental portion 404 are fixedly coupled to one another. In this way, the rim 452 and recessed lip 454 provide overlapping surfaces of the main portion 402 and the supplemental portion 404.

Turning now to FIGS. 10 and 11, top, interior views of the main portion 402 of the outsole 106, with the supplemental portion 404 removed, are shown. FIG. 11 is a more detailed view of an anterior, toe end of the main portion 402 shown in FIG. 10. Specifically, FIGS. 10 and 11 show an interior surface 470 of the main portion 402 of the outsole 106. The interior surface 470 includes an inferior, base surface 472 and side surfaces 474 which extend in a superior direction from the base surface 472. On the medial side portion 416, the interior surface 470 includes the inner surface 458 of the rim 452, where the inner surface 458 is shaped to mate and have face-sharing contact with the outer surface 456 of the recessed lip 454 (as shown in FIG. 9 and explained above).

Figure 12:
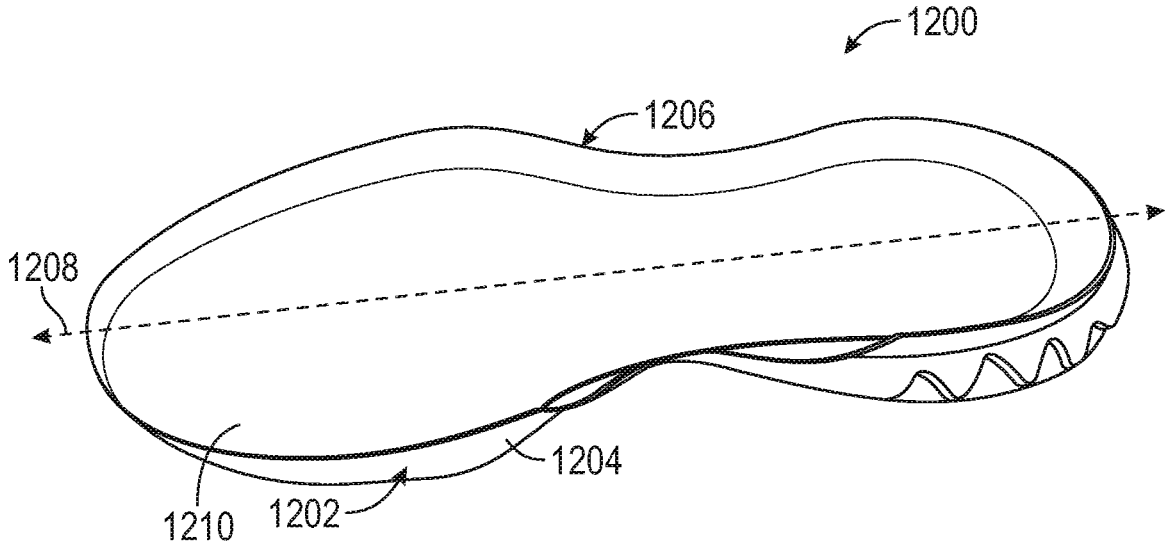
FIG. 12 is a perspective view of a midsole for an article of footwear.

FIG. 12 shows a perspective view of an exemplary midsole 1200 for an article of footwear. The midsole 1200 shown in FIG. 12 may be used as the midsole 108 of the article of footwear 100 shown in FIGS. 1-3. An outer surface 1202 of the midsole 1200 may be coupled to the interior surface of the outsole (e.g., including interior surface 470 of the main portion 402 of the outsole 106). The midsole 1200 includes a medial surface 1204 and lateral surface 1206, arranged opposite one another across a longitudinal axis 1208 of the midsole 1200. Each of the medial surface 1204 and the lateral surface 1206 extend away from a base 1210 of the midsole 1200, in a superior direction. As explained above, different portions of the medial surface 1204 and the lateral surface 1206 may be overlapped (and thus covered from the outside) by portions of the outsole.

In other embodiments, the main portion 402 and the supplemental portion 404 can be coupled to the article of footwear, but are not directly coupled together. For example, the main portion 402 and the supplemental portion 404 can be spaced apart from each other or abut each other. In some embodiments, the main portion 402 and supplemental portion 404 may be arranged adjacent one another but are not overlapping.

Figure 13:
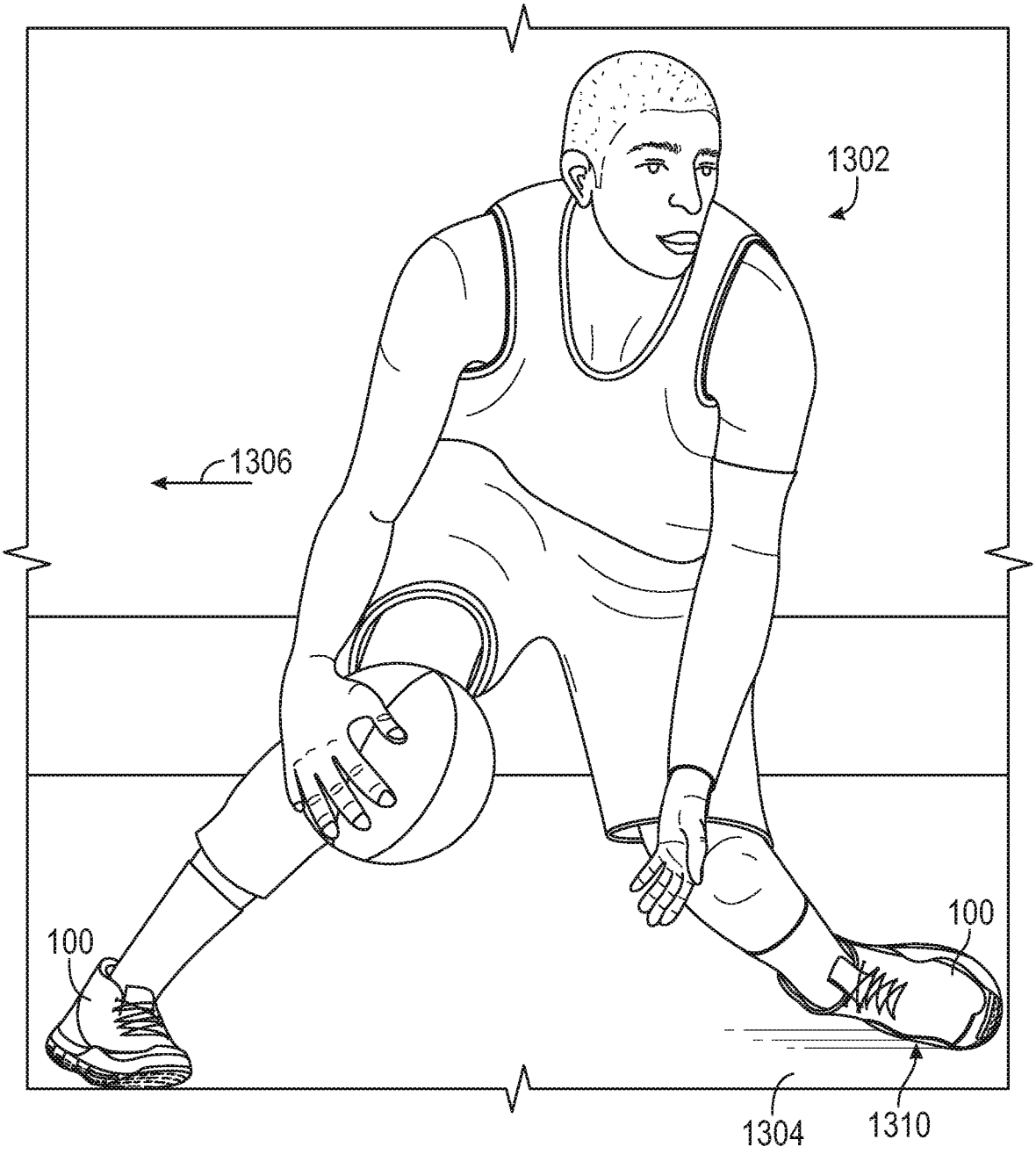
FIG. 13 is a perspective view of the article of footwear in use, as worn by an athlete.

FIG. 13 shows an athlete 1302 wearing the article of footwear 100, which may include the outsole 106 of FIGS. 1-11. The athlete 1302 shown in FIG. 13 is a basketball player moving relative to a ground surface (e.g., the ground surface of a basketball court) 1304. However, in alternate embodiments, the article of footwear 100 may be worn by a different type of athlete, such as a tennis player, a volleyball player, etc., and one or more elements of the article of footwear 100 may be adapted for the intended sport.

As shown in FIG. 13, the athlete 1302 may move (e.g., cut) in a lateral direction 1306 on a right-side of their body, which may cause the left foot (e.g., the foot farthest away from the direction of movement) to roll relative to the ground surface (e.g., ground) 1304 such that at least a portion of the medial side portion 1310 of the article of footwear 100 comes into contact with the ground surface 1304. As discussed herein, the medial side portion of the outsole may extend in a superior direction from an inferior side portion and overlap a midsole and at least a portion of the upper of the article of footwear 100. Further, the medial side portion of the outsole may include first and second traction surfaces with different traction elements that provide increased traction when they come into contact with the ground. Thus, when a wearer's foot rotates in the medial direction such that the medial side portion of the article of footwear 100 comes into contact with the ground surface, as shown in FIG. 13, the first and second traction surfaces of the outsole can contact the ground surface 1304 and provide increased traction to the athlete 1302. This may reduce the likelihood of the athlete 1302 slipping across the ground surface 1304 and enable them to move more quickly and agilely across the ground surface 1304.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. An article of footwear, comprising:

an inferior side portion forming a main ground-contacting surface of the article of footwear;

a medial side portion extending in a superior direction from a first side of the inferior side portion;

a lateral side portion extending in the superior direction from an opposite, second side of the inferior side portion, wherein the medial side portion and the lateral side portion are disposed on opposite sides of the article of footwear and are separated from one another by the inferior side portion; and an outsole extending from the medial side portion, across the inferior side portion, and to the lateral side portion and configured to contact a ground surface, wherein the outsole comprises:

a first portion comprising:

a first traction surface configured for engaging the ground surface, wherein the first traction surface is disposed on the medial side portion and comprises one or more first traction elements disposed on the medial side portion; and a third traction surface disposed on the medial side portion and extending from an end of the first traction surface, proximate to a medial arch region of the outsole, toward a heel portion of the article of footwear, and wherein the first traction surface extends further in the superior direction than the third traction surface; and a second portion having a second traction surface configured for engaging the ground surface, wherein the second portion is disposed on only the medial side portion and extends in the superior direction from the first portion, wherein the first portion and the second portion overlap one another and the first traction surface and the second traction surface are disposed adjacent to one another from an anterior end of the outsole to the medial arch region, and wherein the second traction surface comprises one or more second traction elements.

2. The article of footwear of claim 1, wherein the one or more first traction elements include a plurality of first traction elements spaced apart from one another in both an anterior-to-posterior direction and an inferior-to-superior direction, each first traction element spaced apart from adjacent first traction elements on all sides, wherein the one or more second tractions elements include a plurality of spaced apart, second traction elements, and wherein each of the first traction elements has a different shape and size than each of the second traction elements.

3. The article of footwear of claim 1, wherein a shape and arrangement of the one or more first traction elements on the first traction surface provides the first traction surface with a first texture that is raised and protrudes outward relative to a base of the outsole and a shape and arrangement of the one or more second traction elements on the second traction surface provides the second traction surface with a second texture that is raised and protrudes outward relative to the base of the outsole, the second texture different than the first texture.

4. The article of footwear of claim 1, wherein the one or more first traction elements include a plurality of spaced apart, first raised elements that protrude outward from a base of the first traction surface, wherein the one or more second traction elements include a plurality of spaced apart, second raised elements that protrude outward from a base of the second traction surface, wherein the plurality of first raised elements have a different shape than the plurality of second raised elements.

5. The article of footwear of claim 1, wherein the one or more first traction elements include a plurality of protruding ribs spaced apart from one another in both an anterior-to-posterior direction and an inferior-to-superior direction relative to an anterior end and posterior end of the outsole, the plurality of protruding ribs being non-continuous from an anterior end to a posterior end of the first traction surface, wherein each rib of the plurality of ribs extends in the anterior-to-posterior direction, and wherein the one or more second traction elements include a plurality of protruding nubs spaced apart from one another, where a surface area of each nub of the plurality of nubs is smaller than a surface area of each rib of the plurality of ribs.

6. The article of footwear of claim 1, wherein the first portion includes a curved rim, wherein the second portion includes a complementary, curved, recessed lip, and wherein the curved rim and the recessed lip are adapted to have face-sharing contact with one another and form an overlapping interface between the first portion and the second portion, the overlapping interface undulating along a length of the overlapping interface which extends from the anterior end to the medial arch region of the outsole.

7. The article of footwear of claim 1, wherein the first traction surface and the second traction surface are comprised of a same material.

8. The article of footwear of claim 1, wherein the first traction surface and the second traction surface are comprised of different materials.

9. The article of footwear of claim 1, further comprising a midsole coupled to an interior surface of the outsole and wherein, on the medial side portion, proximate to an anterior end of the outsole and in a region of the first traction surface and the second traction surface, the outsole overlaps an entirety of the midsole.

10. An outsole for an article of footwear, comprising:

a first portion having an anterior side portion, a lateral side portion, a medial side portion, and an inferior side portion, the inferior side portion extending between and separating the lateral side portion and the medial side portion, wherein the inferior side portion defines a main ground-contacting surface of the outsole and the medial side portion and the lateral side portion extend in a superior direction from opposite sides of the inferior side portion, the first portion including:

a first traction surface arranged on the medial side portion and comprising a plurality of first raised elements spaced apart from one another across the first traction surface and disposed on the medial side portion superior to the inferior side portion;

a first non-traction surface formed without raised elements, the first non-traction surface arranged on a superior portion of the anterior side portion and disposed adjacent to a superior portion of the first traction surface; and a third traction surface arranged on the medial side portion and extending from an end of the first traction surface, proximate to a medial arch region of the outsole, across a posterior side portion of the outsole, and to the lateral side portion, and wherein the first traction surface extends further in the superior direction than the third traction surface; and a second portion arranged only on the medial side portion and fixedly coupled to the first portion via an overlapping interface and extending in the superior direction from the first traction surface, along a length of the first traction surface in an anterior-to-posterior direction from the first non-traction surface to the medial arch region, the second portion having a second traction surface comprising a plurality of second raised elements spaced apart from one another across the second traction surface, each of the plurality of second raised elements having a different shape than each of the plurality of first raised elements.

11. The outsole of claim 10, wherein a surface area of each first raised element of the plurality of first raised elements is larger than a surface area of each second raised element of the plurality of second raised elements, wherein the first non-traction surface continues around to the lateral side portion and across an anterior portion of the lateral side portion to a middle-portion of the lateral side portion, and wherein the first non-traction surface includes an undulating rim disposed on its outer, superior edge at the middle-portion of the lateral side portion.

12. The outsole of claim 10, wherein each first raised element of the plurality of raised elements extends outward from a base of the first traction surface, in a medial direction that is away from an interior of the outsole and wherein each second raised element of the plurality of raised elements extends outward from a base of the second traction surface, in the medial direction.

13. The outsole of claim 12, wherein the overlapping interface comprises a rim arranged on the first portion and a recessed lip arranged on the second portion, wherein an outer surface of the rim does not include raised elements and is raised and protrudes outward from the base of the first traction surface and the base of the second traction surface, and wherein an inner surface of the rim is in face-sharing contact with an outer surface of the recessed lip.

14. An outsole for an article of footwear, comprising:

a first portion having an anterior side portion, a lateral side portion, a medial side portion, and an inferior side portion, the inferior side portion extending between the lateral side portion and the medial side portion, the first portion including:

a first traction surface arranged on the medial side portion and comprising a plurality of first raised elements spaced apart from one another across the first traction surface; and a first non-traction surface formed without raised elements, the first non-traction surface arranged on a superior portion of the anterior side portion and disposed adjacent to a superior portion of the first traction surface; and a second portion fixedly coupled to the first portion via an overlapping interface and extending in a superior direction from the first traction surface, along a length of the first traction surface in an anterior-to-posterior direction from the first non-traction surface to a medial arch region of the outsole, the second portion having a second traction surface comprising a plurality of second raised elements spaced apart from one another across the second traction surface, each of the plurality of second raised elements having a different shape than each of the plurality of first raised elements, wherein the plurality of first raised elements include a plurality of ribs arranged in a plurality of columns between an anterior end and posterior end of the first traction surface and arranged in a plurality of rows between the second portion and the inferior side portion of the first portion, each rib of the plurality of ribs having a longer dimension arranged along a direction extending from an anterior end to a posterior end of the outsole, and wherein the plurality of second raised elements include a plurality of spherical nodes, where the longer dimension of each rib is longer than a longest dimension of each spherical node of the plurality of spherical nodes, and wherein the plurality of ribs protrude outward from a base of the first traction surface by a first amount and the plurality of spherical nodes protrude outward from a base of the second traction surface by a second amount, the first and second amounts being the same.

15. An article of footwear, comprising:

an upper; and a sole structure coupled to the upper, the sole structure comprising:

an inner sole;

a midsole; and an outsole having an interior surface coupled to the midsole, the outsole comprising:

a main portion including an anterior side portion, a medial side portion, a lateral side portion, and an inferior side portion connecting the medial side portion to the lateral side portion, wherein the inferior side portion defines a main ground-contacting surface of the outsole and the medial side portion and the lateral side portion extend in a superior direction from opposite sides of the inferior side portion, and wherein the medial side portion includes a first traction surface including a plurality of first traction elements that protrude outward from a base of the first traction surface and the outsole and that are disposed on the medial side portion; and a supplemental portion fixedly coupled to the main portion at a superior portion of the first traction surface and including a plurality of second traction elements that protrude outward from a base of the second traction surface and the outsole, wherein on a medial side of the article of footwear, the main portion and the supplemental portion form an overlapping interface arranged between the first traction surface and the second traction surface, the overlapping interface covering a medial surface of the midsole and an inferior portion of a medial surface of the upper and extending from the anterior side portion to a medial arch region of the outsole, wherein the main portion of the outsole further comprises a third traction surface disposed on the medial side portion and extending from an end of the first traction surface, proximate to the medial arch region, toward a heel portion of the article of footwear, the third traction surface including a plurality of third traction elements, and the first traction surface extending further in the superior direction than the third traction surface, and wherein the plurality of first traction elements includes a plurality of first ribs and the plurality of third traction elements includes a plurality of second ribs that are longer than the plurality of first ribs.

16. The article of footwear of claim 15, wherein the plurality of first traction elements are spaced apart from one another in an anterior-to-posterior direction and in an inferior-to-superior direction, wherein the plurality of second traction elements are spaced apart from one another, wherein each first traction element of the plurality of first traction elements has a different shape than each second traction element of the plurality of second traction elements, and wherein a longer dimension of each first traction element is longer than a longest dimension of each second traction element.

17. The article of footwear of claim 15, wherein the anterior side portion of the main portion includes a first non-traction surface not including traction elements, the first non-traction surface disposed adjacent to a superior portion of the first traction surface, wherein the first non-traction surface continues around to the lateral side portion of the main portion of the outsole and across an anterior portion of the lateral side portion to a middle-portion of a lateral side of the article of footwear, and wherein the first non-traction surface overlaps a lateral surface of the midsole and an inferior portion of a lateral surface of the upper at the middle-portion of the lateral side.

18. The article of footwear of claim 15, wherein the overlapping interface undulates from a first end to a second end of the overlapping interface, and wherein the supplemental portion is arranged only on the medial side portion of the main portion of the outsole.

* * * * *